US007098610B2

(12) United States Patent
Rodriguez

(10) Patent No.: US 7,098,610 B2
(45) Date of Patent: Aug. 29, 2006

(54) INCANDESCENT LIGHT POWER CONTROLLER WITH PREDETERMINED OFF-STATE IMPEDANCE

(75) Inventor: Edward T. Rodriguez, Winchester, MA (US)

(73) Assignee: LongLite, LLC, Portsmouth, NH (US)

( * ) Notice: Subject to any disclaimer, the term of this patent is extended or adjusted under 35 U.S.C. 154(b) by 4 days.

(21) Appl. No.: 11/058,760

(22) Filed: Feb. 16, 2005

(65) Prior Publication Data

US 2006/0022611 A1 Feb. 2, 2006

Related U.S. Application Data

(60) Provisional application No. 60/591,675, filed on Jul. 28, 2004.

(51) Int. Cl.
*H05B 37/00* (2006.01)

(52) U.S. Cl. ..... 315/291; 315/124; 315/127

(58) Field of Classification Search ..... None
See application file for complete search history.

(56) References Cited

U.S. PATENT DOCUMENTS 3,836,814 A 9/1974 Rodriguez
3,896,334 A 7/1975 Rodriguez
4,309,639 A * 1/1982 Thrower et al. ..... 315/82
4,547,704 A 10/1985 Brinn et al.
4,980,607 A 12/1990 Albert et al.
5,537,008 A * 7/1996 Matsuda et al. ..... 315/200 R

OTHER PUBLICATIONS

SCR Manual, Fifth Edition, 1972, pp. 231-233 and pp. 252-253, General Electric, Syracuse, NY.
Thyristor Product Catalog, 2002, pp. E9-1-E9-3, Teccor Electronics, Irving, Texas.

* cited by examiner

*Primary Examiner*—David Vu
(74) *Attorney, Agent, or Firm*—Cesari and McKenna, LLP; Edwin H. Paul, Esq.

(57) ABSTRACT

An incandescent light bulb life extender circuit is designed to attach to the screw base of a conventional light bulb or incorporated in series with the AC powering the bulb. The circuit employs a bidirectional semiconductor switch that reduces the brightness of the bulb marginally while significantly extending the bulb's life. The values of the life extender are selected to operate with standard available light dimmers with no undesirable flicker or compromise of reasonable brightness control. A controller consists of the life extending circuit and a) an appropriate molded insulating housing, b) electrically conductive metallic discs for making electrical contacts to a light bulb base and corresponding socket and c) selected electronic components, connected to said discs, to facilitate the intended electrical performance.

13 Claims, 5 Drawing Sheets

INCANDESCENT LIGHT POWER CONTROLLER WITH PREDETERMINED OFF-STATE IMPEDANCE

CROSS REFERENCE TO RELATED APPLICATIONS

The present application claims the priority benefit of an earlier filed provisional application of common inventorship. This provisional application has Ser. No. 60/591,675 and was filed on Jul. 28, 2004, and this provisional application is hereby incorporated herein by reference.

FIELD OF THE INVENTION

The present invention relates to control of incandescent bulbs or lamps, and more particularly to control of single or multiple bulbs with co-located electronics. Co-located defined herein as being built into or attached to the bulb itself or into the bulb mounting socket.

BACKGROUND OF THE INVENTION

The basic incandescent light bulb dimmer has existed as a commercial product for over 40 years (hereinafter lamp and light bulb are used interchangeably). The lamp dimmer became practical with the development of a class of semiconductor solid state switch devices known as thyristors that were introduced to the electronics markets in the early 1960's. Prior to that time, such dimmers consisted of rheostats, a form of variable power resistors.

Rheostats dimmed an incandescent lamp by transferring a selectable percentage of power from the lamp to the rheostat. Rheostat dimmers generated substantial heat, limiting their use. The use of thyristor dimmers generated dramatically less heat. These solid state devices provided efficient dimmers by rapidly switching power to a lamp on and off in a prescribed manner to efficiently dim the lamp. The solid state thyristor switch was fully on or off, generating little heat thereby improving efficiency. This sharp reduction in heat made possible the commercialization of popular wall-mounted lamp dimmers that are commonly found in homes.

Over the last 40 years, hundreds of patents have been issued on incandescent bulb dimmer circuits and their physical design characteristics. During that time, the basic and common circuit approach to lamp dimmers has continued to be a technique known as phase control. This technique is commonly found in controllers for lamps, heaters and motor speed controls (drills, saws, electric cars) and is well understood by those skilled in the art.

U.S. Pat. No. 3,896,334 ('334) illustrates the use of thyristors. This patent is incorporated herein by reference.

In known applications, a resistor and capacitor are connected in series to form a charging circuit for the capacitor. During each half cycle of the AC line voltage (the power source), the capacitor charges towards the line voltage. However, at a predetermined voltage, the capacitor discharges, triggering a triac into conduction, thereby turning on the lamp by applying the full AC line voltage to the lamp. The triac turns off, thereby turning off the lamp, on each half cycle when the AC voltage returns to about zero volts. The triac noted here is a known type of thyristor which exhibits bi-directional or bi-lateral switching characteristics. Such a triac is described in "The General Electric, SCR Manual" fifth edition. This manual is referred to as Reference 1.

This charge and discharge of the capacitor occurs each half cycle, with the capacitor being essentially reset at the end of each half cycle. The ratio of on to off of the triac and lamp, each half cycle, determines the average power delivered to the lamp and therefore sets the brightness (and the dimming) level. Persistence of vision associated with the human eye makes the switching on and off of the lamp each half cycle imperceptible. Such use of a phase control circuit to control lamp illumination is very well known and the principles of such circuits are described in many patents and in Reference 1.

In an adjustable lamp dimming device, the resistor portion of the charging circuit is typically a potentiometer, thereby allowing the user to vary the RC time constant involved and thereby the time to reach the capacitor discharge point. In a fixed illumination application, the triac or other thyristor type device turns on at a predetermined point, and the potentiometer can be replaced by a fixed resistor. U.S. Pat. Nos. 3,836,814 and 4,547,704 describe use of such a fixed resistor value, and these patents are incorporated herein by reference.

In other applications, a resistor, capacitor, triac and a diac (another semiconductor switching device also described in Reference 1) form a dimming circuit. These devices can all be replaced by a single thyristor device called a sidac which, on each AC power half cycle, senses the amplitude of the AC line voltage and exhibits a controlled avalanche into full conduction (fully on). Avalanche is a well known term in the art. U.S. Pat. No. 4,980,607 describes such a design and is incorporated herein by reference. Teccor Div. of Littlefuse Corp., Thyristor Product Catalog and Application Notes, published in 2002, herein after Reference 2, describes the theory of operation of a sidac.

In known dimming circuits, particular resistors or potentiometers, capacitors, thyristos, diacs and their operating specifications are well known to those skilled in the art. In ordinary dimmers there is usually a mechanical on/off switch whereby the lamp is turned off regardless of the setting of the dimmer. Such a mechanical switch is not further discussed herein.

While conventional wall mounted lamp dimmers have become a commonplace, economical commodity, derivatives of this technology are now also being built into the lamp or the lamp fixture itself. Typically these built-in electronic devices perform as life-extending devices rather than as lamp dimmers since these electronic devices are not easily accessible.

Consequently in a given lamp application, there may be two circuits in series: one to extend lamp life (while minimally dimming the lamp), and a second circuit that provides a range of brightness control (dimming). In such a situation undesirable interaction, instability and other anomalous operations can occur due to these two circuits. Typically, flicker, erratic, and non-linear dimming occurs. For example, if a light bulb has a built in (via its socket or cord) switching circuit meant to extend the bulb life and an external dimmer circuit (like a wall mounted dimmer), the dimmer circuit, rather than seeing a low resistance charging path of the bulb filament only, will see an off switch, e.g. an off thyristor. An off thyristor might exhibit an equivalent resistance of over several megohms. In such a condition, the timing capacitor in the wall-mounted dimmer may take more than a few AC line half cycles to charge, thereby upsetting the normal discharge/reset mechanism in the dimmer. Dimmer mechanisms are intended to switch on allowing portions of each AC line half cycle to reach the bulb filament. Such disruption of the normal discharge/charge mechanism can result erratic light behavior, like visible flickering and diminished range of dimming control.

In the commonly used dimmer circuits described above, a capacitor charges through a resistor and the low resistance lamp filament. However, in the above mentioned case where a wall-mounted dimmer and a life extending semi-conductor device are combined in series with the bulb filament, the capacitor will not charge in the normal fashion. The off life extending semiconductor will cause erratic operation of the combination.

It is an objective of this invention to minimize such undesirable effects as described above, thereby providing compatibility between life extending devices and ordinary light dimmers whenever they are used together.

SUMMARY OF THE INVENTION

The limitations of the known prior art are addressed in the present invention. The present invention provides apparatus and methodology wherein a lamp with a co-located life extending semi-conductor switch, used with an adjustable commonplace dimmer, exhibits no erratic behavior. Note the terms "switch" and "switch device" are used interchangeably herein. The charging of the timing capacitor in the dimmer operates substantially as if there were no co-located device present. The present invention provides for the principal series resistance through which the capacitor is charged to be the timing resistance in the dimmer. This ensures that the dimmer operates normally.

In operation, the present invention provides for a co-located life extending switch circuit to independently sense the AC line voltage and trigger on at a predetermined level whether or not a separate dimmer is used. Similarly, the present invention meets the dimmer requirements of a predictable, always present charging circuit in order to reset itself each half cycle and properly dim the bulb even with the co-located life extending switch in place.

The inventive controller may be embodied in a circuit that contains, inter alia, the semiconductor switch that extends the life of the bulb. The circuit may be located in an attachment between the bottom electrical contact in the base of the bulb and the lower electrical contact in a socket or receptacle meant to receive the base of the bulb. The circuit may be placed, however, in the bulb itself, in power cord associated with the lamp, in a fuse box, or virtually anywhere in the AC power lines that lead to the lamp. The circuit will typically be mounted in an attachment that is convenient for the location selected.

One attachment may include an electrically insulating housing shaped to fit over the bottom of the light bulb. The housing has a center through hole arranged in line the bottom electrical contact in the base of the bulb.

The attachment may be constructed in a sandwich assembly including an upper electrically conductive member, positioned between the housing and the base making electrical contact with the lower electrical contact in the base, and a lower electrically conductive member, positioned in line with the through hole. The lower electrically conductive member is positioned on the distal side of the housing with respect to the base.

The base, housing and sandwich assembly are arranged to fit into the socket and make functional electrical contact with the center contact in the socket.

The sandwich assembly includes a bilateral voltage-triggered semiconductor switch device and an electrically parallel resistor. The resistor may be integrated into the structure of the bilateral switching device itself or be a separate component. The semiconductor switching device has an upper electrical contact electrically connected to the upper member and a bottom electrical contact electrically connected to the bottom member.

If the resistor is a separate component in the sandwich assembly, it also would have a upper and lower contact that make electrical connections to the upper and lower members, respectively, in the same manner as the semiconductor switch device.

Incorporating the resistance into the same chip with the semiconductor switching device can be accomplished by a number of process techniques, well known in the art. One such technique is known as "shorting dots." Shorting dots have been used for many years for creating controlled resistances between two points on a thyristor chip. U.S. Pat. No. 4,673,844 to Maytum illustrates the technique. The bilateral switching device with incorporated resistor embodiment of the present invention may employ such a technique.

When the attachment is used with a lamp, the parallel semiconductor device and resistor are functional electrically in series with the filament within the incandescent bulb.

In one preferred embodiment, an adhesive-backed compressive foam washer is applied to the base of the bulb. The attachment is pressed to the base with the attachment in line with the bottom contact of the bulb, and therefore in line with the center contact of a socket arranged to receive the bulb.

The upper and lower electrically conductive members are typically disks constructed larger that the through hole in the housing. The upper and lower disks are soldered, respectively, to the upper and lower electrical contacts of the semiconductor and parallel resistor and form a sandwich assembly at the hole in the housing where the disks are on both sides of the hole and are retained by the housing.

In a preferred embodiment, the resistance value of the parallel resistor and the trigger level of the semiconductor switch are selected so that the semiconductor switch device triggers at a voltage level of about 120 volts. The semiconductor switch device turns off when the voltage across the semiconductor switch reaches zero volts.

The inventive attachment is constructed to attach to the bottom of the base of an incandescent light bulb and be electrically in series with the light bulb filament. The present invention is designed to be used with ordinary incandescent light dimmers without the limitations of the prior art. The ordinary dimmers typically have a timing resistor and capacitor that form an RC time constant. The capacitor charges up on each AC line half cycle and triggers a semicondcutor switch device in the dimmer—typically a triac.

The parallel resistor value and the timing resistor value are selected so that the set trigger voltage level is reached on every half cycle of an AC power line waveform.

The timing resistor may be replaced by a potentiometer. The minimum resistance value of the timing potentiometer may be set, for example, equal to the resistance of the parallel resistor.

The inventive attachment may be used with multiple bulbs all controlled by a single light dimmer. In such a case the bulbs and their attachments are all in parallel with each other. In this case the effect of the parallel resistors is minimized with respect to the operation of the dimmer.

It will be appreciated by those skilled in the art that although the following Detailed Description will proceed with reference being made to illustrative embodiments, the drawings, and methods of use, the present invention is not intended to be limited to these embodiment and methods of use. Rather, the present invention is of broad scope and is intended to be defined as only set forth in the accompanying claims.

BRIEF DESCRIPTION OF THE DRAWINGS

The invention description refers to the accompanying drawings, of which

DETAILED DESCRIPTION OF PREFERRED EMBODIMENTS

Figure 1:
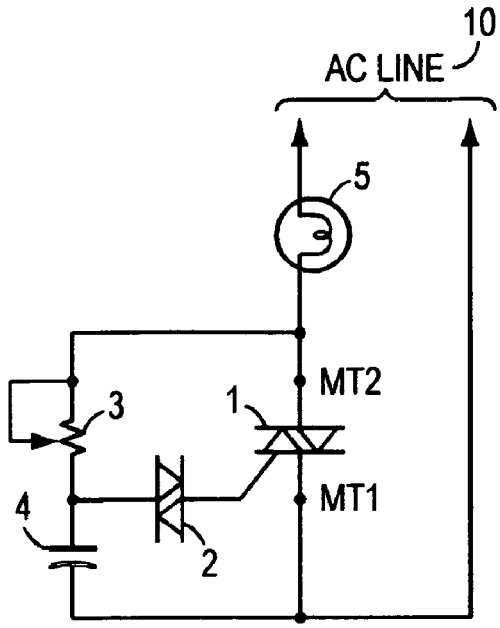
FIG. 1 is a circuit schematic of a phase control lamp dimmer.

In FIG. 1, the circuit consists of triac 1, diac 2, variable resistor (i.e. potentiometer) 3 capacitor 4 and incandescent lamp and filament 5. The triac is a three terminal device, having two terminals, MT1 and MT2, which act as the two terminals of an on/off switch. The diac is a bilaterial switching device which switches from off to on (with a voltage offset) when a suitable voltage is impressed across its two terminals. The capacitor charges up via items 3 and 5 to a voltage level that triggers of the diac.

At the beginning of each half cycle of the AC line voltage, the capacitor 4 begins to charge toward a voltage level corresponding to the specified breakover threshold of diac 2. The diac switches from an off state to a condition of conduction substantially discharging the capacitor 4.

The discharge path for the capacitor is through the diac and the internal triac impedance between MT1 and the gate terminal G. When the diac gconducts, sufficient voltage is impressed, between G and MT1, to provide a gate current within the triac 5. This gate current triggers the triac from an off state to an on state, analogous to closing a switch between MT1 and MT2.

The diac turns on when a voltage, typically about 34 volts, is impressed across the diac. When the diac is on there is a remaining offset voltage, typically about 24 volts, across the diac. As a result, the capacitor does not fully discharge. The most important thing is that there be a momentary partial discharge of the capacitor sufficient to trigger the triac on. The nature of the triac is that once triggered on it latches on even when the gate signal is removed. The triac will stay on until the end of the AC line half cycle where current flow through the trias goes to zero. At that point the triac unlatches and turns off.

With larger values of resistance (items 3 and 5 in FIG. 1) in the RC timing circuit, it will take longer to adequately charge C1 to trigger the diac and the triac. The longer the delay, the further into the half cycle of the AC line voltage before the triac 1, of FIG. 1, switches on, the lower the power to the lamp, and the lower the brightness.

Since the diac and triac operate bilaterally, each half cycle, the process repeats itself. Since C1 does not completely discharge each half cycle, it begins a new half cycle with some charge remaining. Practitioners in the art understand this and have developed circuitry accommodating this effect.

Figure 2A:
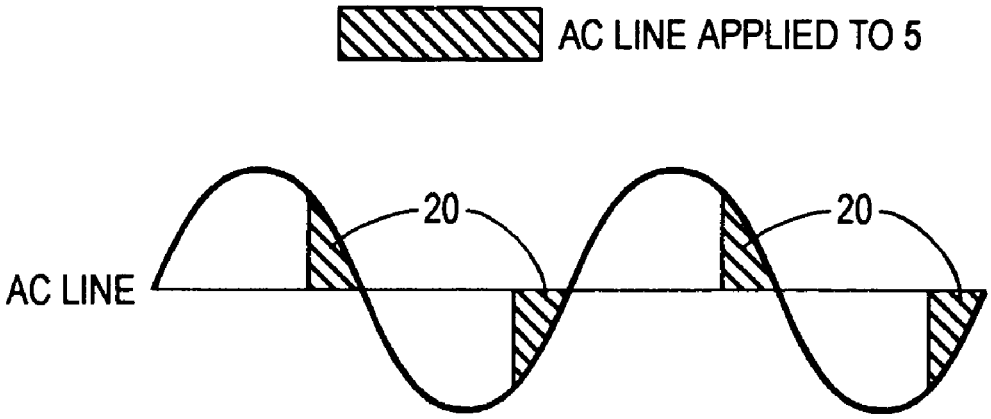
FIGS. 2A, 2B, and 2C are time charts illustrating phase control of an AC line voltage applied to a lamp.
Figure 2B:
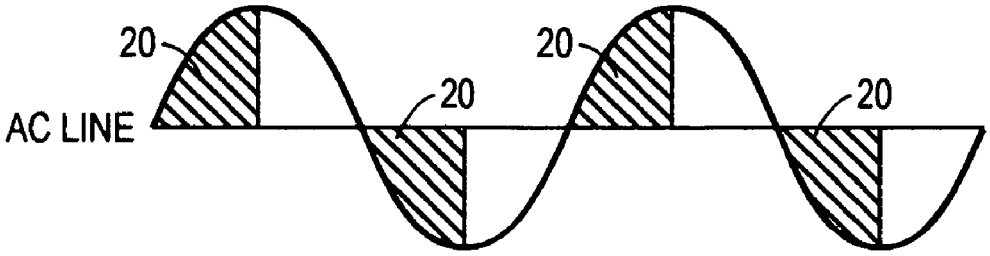
Figure 2C:
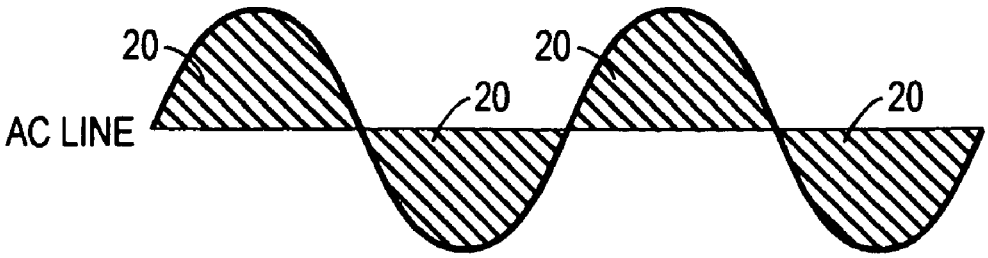

FIG. 2 shows the input AC line voltage sine wave applied to the lamp at the arrows. In the dim setting of FIG. 2A, the potentiometer is set to a relatively high value where the capacitor does not reach the triggering point until near the end of the half cycle, near 8 milliseconds. In the mid-brightness setting of FIG. 2B, the potentiometer is set to a mid range and the delay is closer to 4 milliseconds. In this instance about half the available power is sent to the lamp filament, and the brightness of the lamp follows accordingly. For full brightness, FIG. 2C, the potentiometer would typically be set close to its minimum value and the capacitor would charge more quickly. That in turn would cause triggering very early in the half cycle and deliver most of the AC line power directly to the lamp filament.

Figure 3:
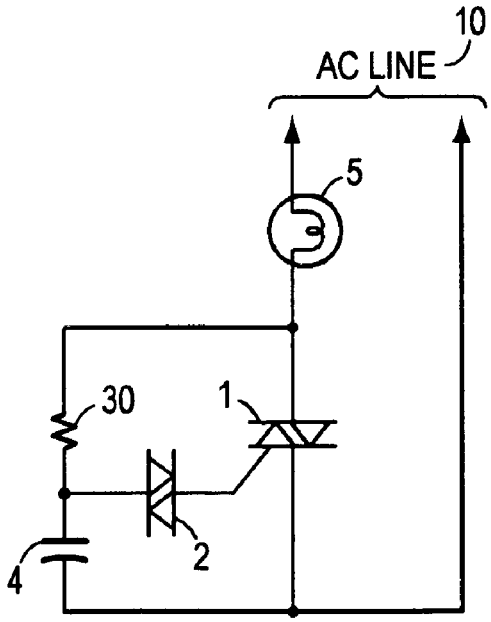
FIG. 3 is a circuit schematic of a phase control lamp employing a fixed phase angle.

FIG. 3 shows the circuit of FIG. 1 in which the potentiometer is replaced by a fixed resistor 3. Here the lamp brightness is set permanently to a given level that is just slightly less than full bright, e.g. as in FIG. 2C. It is well known in the lighting industry that operating an incandescent lamp at slightly less than the normal power will slightly reduce the brightness but very substantially increase lamp life. For example, a 10% drop in both lamp voltage (and thus power to the lamp) and brightness might quadruple lamp life.

Figure 4:
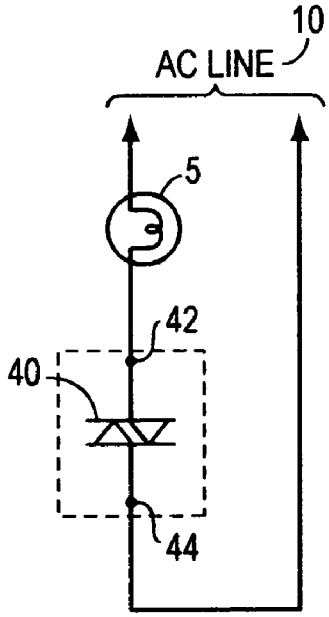
FIG. 4 is a circuit schematic of a bidirectional semiconductor (sidac) in series with a lamp filament.

While the circuit of FIG. 3 could achieve the result as just noted, the circuit of FIG. 4 provides a more economical approach. In FIG. 4 the triac, diac, resistor and capacitor are all replaced by a sidac 40 in series with the lamp 5 filament. The sidac is a two terminal bidirectional thyristor-type switching device described in detail in Reference 2.

Structurally much like a triac, the sidac does not have a third terminal for triggering. Instead it is triggered when the voltage across its two terminal exceeds a specified amplitude much like the two terminal diac of FIG. 1. However, the sidac, when triggered into conduction, acts more like a triac, with an on voltage drop across its terminals of only about one volt. Because its on state more closely approximate the condition of a closed switch, the sidac can conduct substantial continuous current without having excessive heat dissipation.

The circuits of FIGS. 1 and 3 use an RC time constant charging the capacitor to the trigger level of the triac or diac/triac combination. In contrast, the sidac, FIGS. 4–7, switches or triggers on at some voltage amplitude. For example, a sidac bidirectional switching device, specified for a breakover voltage of 120 volts, will turn on at a point in the AC line half cycle equal to an amplitude of 120 volts, which just happens to be a little over a millisecond into the AC line 60 Hz sine wave. The single sidac component of FIG. 4 performs as do the RC timing circuits, but without the capacitor, resistor or potentiometer, or diac.

The circuit of FIG. 4 can be employed as an adapter with a conventional light bulb 5 to extend bulb life. U.S. Pat. Nos. 4,980,607 and D423,453 are embodiments of such a function, and these patents are incorporated herein by reference.

Figure 5:
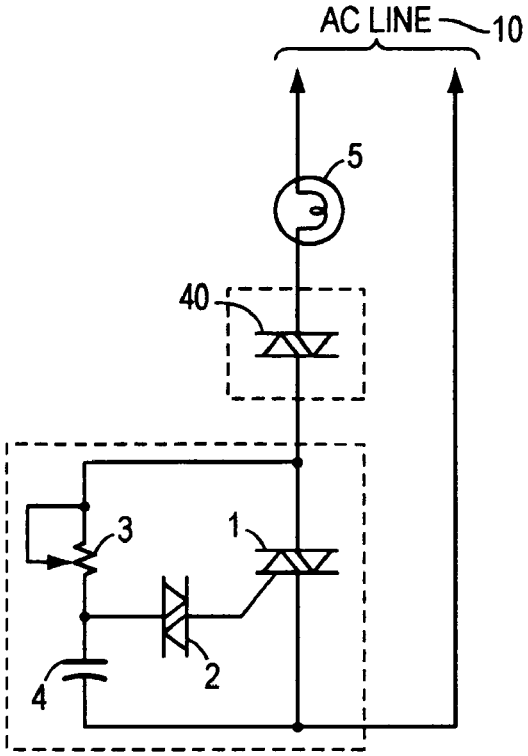
FIG. 5 is a circuit schematic of an adjustable lamp dimmer used with the sidac of FIG. 4.

If the adapter of FIG. 4 is combined and controlled by a conventional wall dimmer circuit as shown in FIG. 5, the off-state sidac 40 resistance of several megohms substantially reduces the charging current for the timing RC circuit of FIG. 5. The resultant long charging period causes the dimmer to completely skip some AC line half cycles, exhibit erratic brightness control, and it is likely that the lamp will unacceptably flicker.

Figure 6:
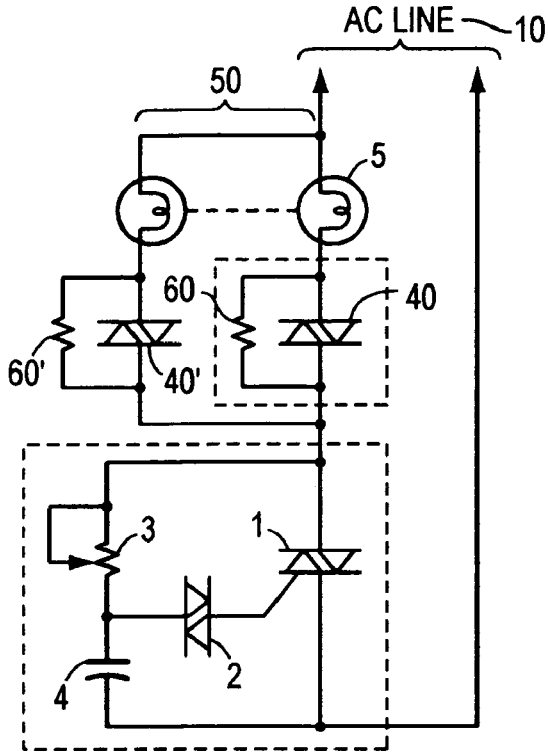
FIG. 6 is the circuit of FIG. 5 with multiple bulbs each with a fixed resistor shunting the sidac.

Shunting the sidac with an appropriate resistor as in FIG. 6 allows the dimmer to function in a closer-to-normal fashion by ensuring that the capacitor always has the intended relatively low resistance charging path through the resistor 60. If multiple lamps 50 with sidacs 40' paralleled with resistors 60' are used with a single dimmer, the dimmer would work closer to normal since there would be a smaller resistance in the charging path for the RC circuit.

As noted earlier, the shunt resistor may be integrated into the bidirectional switching device (sidac) by means of "shorting dots" or by other comparable techniques as known in the art, and as discussed in the previously incorporated herein Maytum U.S. Pat. No. 4,674,844. For simplicity, the following discussion treats the parallel resistor as if it were a physically separate component.

Figure 7:
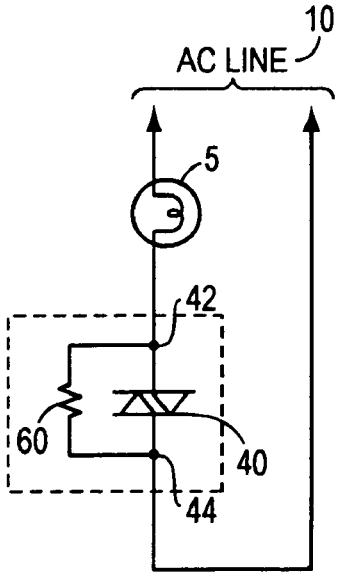
FIG. 7 is a circuit schematic of a preferred embodiment of the present invention.

The operation of the circuit in FIG. 6 starts with both sidac 40 and triac 1 off. A rising AC line voltage 10 is applied across the arrows. The capacitor 4 charges through resistor 60 (and 60" if present) and potentiometer 3. The resistor 60 is selected to ensure that during an AC line half cycle the voltage across the capacitor 4 reaches a level to trigger the diac 2 and the triac 1. When the triac triggers, the full AC line voltage is impressed across the bulb filament and the sidac 40. Since the sidac triggers with about 120 volts, it immediately triggers and the AC line voltage, minus the small offset voltages across the sidac and triac, appears across the bulb filament. The potentiometer 3 is selected with a range that dims the brightness of the bulb by changing how much of the AC line voltage cycle appears across the filament. The component values and trigger thresholds are selected, as known to those skilled in the art, to allow a reasonable dimming range while minimally reducing the brightest level. For example with one lamp and sidac, the resistor 60 and the potentiometer 3 at its smallest value (for minimum FIG. 7 depicts a simple preferred circuit embodying the present invention, and FIG. 6 shows the simple preferred circuit combined with an adjustable dimmer. As previously noted, the resistor 60 shunting the sidac can be selected to ensure that the potentiometer 3 is the principal determinant of the RC time delay for most of the brightness range and particularly at settings for relative low light levels. For example, a typical commercially popular 600 watt wall dimmer has a potentiometer which is set at 1K to 25K at full brightness and 150K to 250K for the lowest perceptible light level. If the resistor 60 was under 20K it would add only about 10% (of the 200K) to the time constant determinant at low brightness levels.

The minimum value of the shunt resistor is determined by a judgment of the average power dissipation of the shunt resistor during normal operation. If the resistor 60 is of a low value, such as below 1K, it conduct substantial current and contribute substantial heat to the metal substrate to which the Sidac is attached. This could degrade the sidac. Once the sidac triggers, it bypasses the shunt resistor and such dissipation is virtually eliminated for the remainder of the half cycle. In other words, the consideration of resistor dissipation is only relevant for that portion of the AC line half cycle in which the sidac is off. Typically, the average (over an entire AC line cycle) dissipation is preferably kept to below one watt, and the shunt resistor would be in the 5K–20 K range. Of course, the specific power rating of the adapter must accommodate the dissipation level.

Figure 8A:
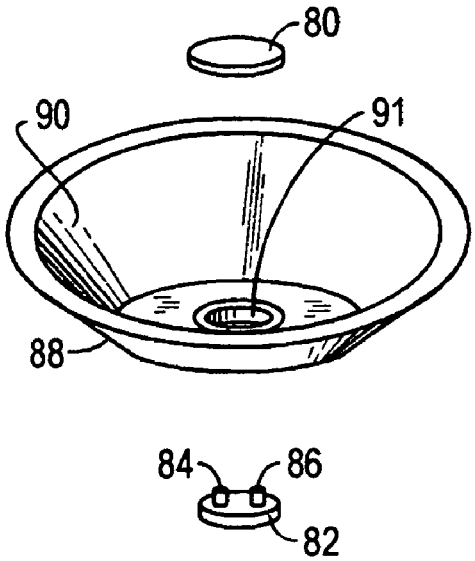
FIGS. 8A, 8B are exploded views in cross section of a bulb adapter incorporating the circuit of FIG. 7.
Figure 8B:
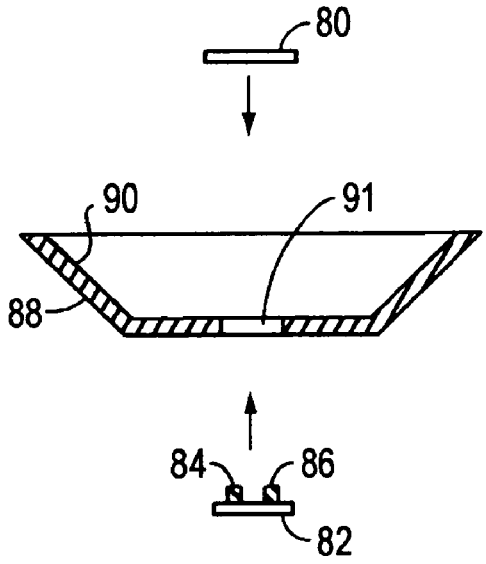

FIGS. 8A and 8B depict an exploded view and a cross section of the adapter. Shown are an upper thermally conductive metal disk 80, a lower thermally conductive metal disk 82, a sidac chip 84, a resistor chip 86, a plastic or other insulating material housing 88 with an adhesive backed foam layer 90 on its inner surface and a centered through hole 91.

Figure 9:
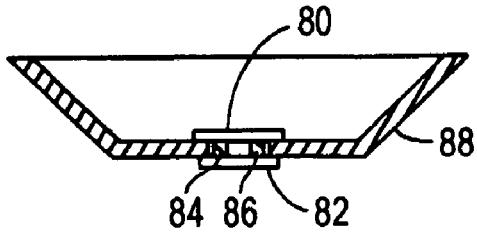
FIG. 9 is a cross section of the completed adapter of FIGS. 8A and 8B prior to attachment to a bulb.

The sidac 84 and the resistor 86 are electrically connected as shown in FIG. 7, contacts 42 and 44. The sidac 84 and the resistor 86 chips are first soldered to the lower disk 82. FIG. 8B shows the upper disk 80 approaching the through hole 91 from the top and the lower disk 82 with the attached sidac and resistor chips, 84 and 86, respectively, approaching the through hole from below. The upper disk is then soldered to the lower disk. FIG. 9 shows the finished sandwich assembly. The upper disk corresponds to the electrical contact point 42 in FIG. 7 and the lower disk to point 44.

In other assembly methods the two metal disks, 80 and 82 with the chips 84 and 86 can be positioned on either side of the housing 88 and then soldered in place. Other techniques will be known to those skilled in the art.

In practice, the disks 80 and 82 are larger than the through hole 91, so that after soldering the chips are confined in the through hole as shown in FIG. 9.

Also, the adhesive coating 90 on the inner surface of the housing 88 may be a separate foam flat donut shape (not shown) with adhesive on both sides. One side of the foam is place on the inner surface of the housing 88 and the other adhesive side of the foam 90 is ready for assembly to a conventional light bulb as next described.

Figure 10A:
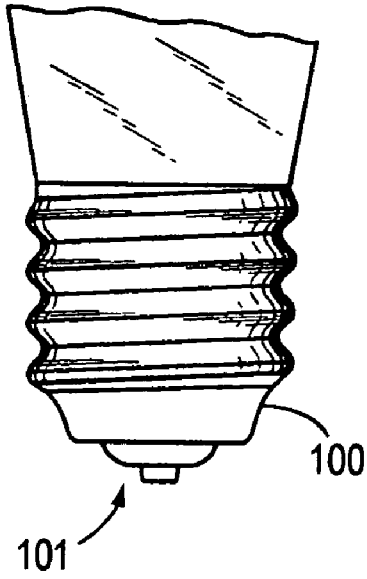
FIGS. 10A, 10B are pictorials illustrating the adapter as it attaches to a bulb.
Figure 10B:
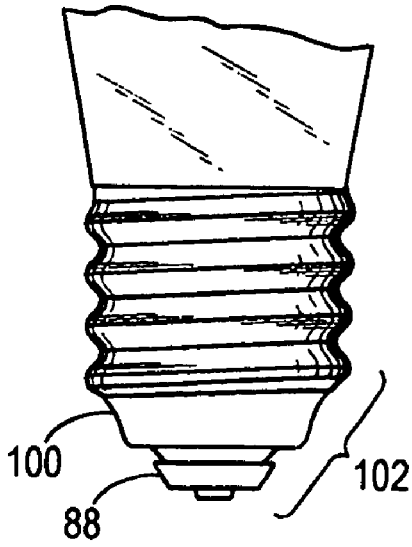

FIG. 10A shows a standard base of a conventional light bulb, and FIG. 10B shows the controller attachment as it is being placed over the bottom of the bulb. The final assembly is secured by pressing 102 the adhesive coated side 90 of the inventive controller assembly onto the bottom 101 of the base of the conventional light bulb. This bulb/adapter combination can then be inserted in a conventional lamp socket just as would a standard incandescent light bulb.

What is claimed is:

1. An attachment for an incandescent light bulb to extend the life of the bulb, the attachment located between the bottom electrical contact in the base of the light bulb and a lower electrical contact in a socket constructed to accept the base of the light bulb, the attachment comprising:

an electrically insulating housing shaped to fit over the bottom of the light bulb, the housing having a centered through hole arranged in line with a bottom electrical contact in the base of the light bulb, an upper electrically conductive member positioned between the housing and base and constructed to make electrical contact with the lower electrical contact in the base of the light bulb, a lower electrically conductive member positioned in line with the through hole, the lower electrically conductive member positioned on the distal side of the housing with respect to the base of the light bulb, wherein the lower electrically conductive member is arranged to fit into the socket and make electrical contact with the center contact in the socket, a bilateral voltage-triggered semiconductor switch device, a resistor functionally electrically connected in parallel with the semiconductor switch device, and semiconductor switch device and the parallel resistor having an upper electrical contact and a bottom electrical contact, the upper electrical contact making electrical connection to the upper electrically conductive member and the lower electrical contact making contact with the bottom electrically conductive member, wherein the housing, the upper and the lower electrically conductive members with the semiconductor switch device and resistor, fit into the socket wherein the semiconductor switch device and resistor are electrically in series with the filament within the incandescent bulb.

2. The incandescent light bulb life extended attachment of claim 1 wherein the parallel resistor is integrated into the same chip as the semiconductor switch device.

3. The incandescent light bulb life extended attachment of claim 1 wherein the parallel resistor is a physically separate component.

4. The incandescent light bulb life extender attachment of claim 1 further comprising:

an adhesive applied to surface of the housing wherein the adhesive holds the housing the bottom of the base of the light bulb, and wherein the upper and lower electrically conductive members are disks, each constructed larger than the through hole in the housing, and wherein the upper and lower disks are soldered, respectively, to the upper and lower electrical contacts of the semiconductor and parallel resistor.

5. The incandescent light bulb life extender attachment of claim 1 wherein the resistance value of the first resistor and the trigger level of the semiconductor switch device are selected so that the semiconductor switch device triggers at a voltage level of about 120 volts, and wherein the semiconductor switch device turns off when the voltage across the semiconductor switch device reaches about zero volts.

6. An incandescent bulb circuit comprising:

an attachment as defined in claim 1 constructed to attach to the bottom of the base of an incandescent light bulb, wherein the attachment is electrically in series with the light bulb filament, a timing resistor, a timing capacitor electrically in series with the timing resistor forming an charging circuit, the resistor—capacitor, RC, combination constructed functionally in electrical contact with the center contact of the socket, a second semiconductor, bilateral or unilateral, constructed with a set trigger voltage level, the second semiconductor functionally connected to the timing capacitor to trigger when a charge on the timing capacitor reaches the set trigger voltage level, wherein the parallel resistor value and the timing resistor value are selected so that the set trigger voltage level is reached on every half cycle of an AC line wave form.

7. The incandescent bulb circuit of claim 6 wherein the resistance value of the parallel resistor ranges from about ten to twenty percent of the resistance value of the timing resistor.

8. The incandescent bulb circuit of claim 6 wherein the timing resistor is a potentiometer, and wherein the minimum resistance value of the potentiometer is about equal to the resistance value of the parallel resistor.

9. The incandescent bulb circuit of claim 6 further comprising several attachments as defined in claim 1, each attachment constructed to attach, respectively, to the bottom of the bases of incandescent light bulbs, wherein the attachments are electrically in series with the light bulb filaments, and wherein the center contacts of the sockets are functionally electrically connected to each other.

10. A circuit for an incandescent light bulb to extend the life of the bulb, the circuit located in series with the filament of the bulb, the filament having a first and a second end with the first end functionally connected to one lead of an AC power line, the AC power line having a second lead, the circuit comprising:

a bilateral voltage-triggered semiconductor switch device, a resistor functionally electrically connected in parallel with the semiconductor switch device, and semiconductor switch device and the parallel resistor having an upper electrical contact and a bottom electrical contact, wherein the upper electrical contact is functionally connected to the second lead of the AC power line, and the bottom electrical contact is functionally connected to the second end of the filament.

11. The circuit of claim 10 further comprising:

a timing resistor, a timing capacitor electrically in series with the timing resistor forming a charging circuit, the resistor—capacitor, RC, combination constructed functionally in electrical series with one of the AC power lines, a second semiconductor, bilateral or unilateral, constructed with a set trigger voltage level, the second semiconductor functionally connected to the timing capacitor to trigger when a charge on the timing capacitor reaches the set trigger voltage level, wherein the parallel resistor value and the timing resistor value are selected so that the set trigger voltage level is reached on every half cycle of an AC line wave form.

12. The circuit of claim 11 wherein the resistance value of the parallel resistor ranges from about ten to twenty percent of the resistance value of the timing resistor.

13. The circuit of claim 11 wherein the timing resistor is a potentiometer, and wherein the minimum resistance value of the potentiometer is about equal to the resistance value of the parallel resistor.

* * * * *